United States Patent [19]

Billingsley et al.

[11] Patent Number: 5,022,355

[45] Date of Patent: Jun. 11, 1991

[54] INTERNAL COMBUSTION ENGINE

[75] Inventors: Henry C. Billingsley, Kenosha, Wis.; Glenn R. Belec, Gurnee, Ill.

[73] Assignee: Outboard Motor Corporation, Waukegan, Ill.

[21] Appl. No.: 512,951

[22] Filed: Apr. 23, 1990

[51] Int. Cl.[5] ..... F23K 5/00; F02B 29/02

[52] U.S. Cl. ..... 123/52 MB; 123/73 A; 123/468; 123/469

[58] Field of Search ..... 123/73 A, 52 MB, 468, 123/469, 456, 451

[56] References Cited

U.S. PATENT DOCUMENTS

| | | | |
|---|---|---|---|
| 2,001,669 | 5/1935 | Smith | 123/52 MB |
| 3,505,983 | 4/1970 | Hartel | 123/52 MB |
| 4,314,529 | 2/1982 | Motosugi et al. | 123/52 MB |
| 4,457,280 | 7/1984 | Hudson, Jr. | 123/468 |
| 4,660,531 | 4/1987 | Lauterbach et al. | 123/469 |
| 4,702,202 | 10/1987 | Hensel et al. | 123/52 M |
| 4,789,187 | 1/1989 | Hudson, Jr. | 123/469 |
| 4,815,427 | 3/1989 | Radtke | 123/52 MB |
| 4,899,712 | 2/1990 | De Bruyn et al. | 123/469 |
| 4,917,053 | 4/1990 | Okazaki | 123/73 A |
| 4,922,958 | 5/1990 | Lemp | 123/456 |

*Primary Examiner*—Willis R. Wolfe
*Assistant Examiner*—Thomas N. Moulis
*Attorney, Agent, or Firm*—Michael, Best & Friedrich

[57] ABSTRACT

An internal combustion engine comprising an engine block including first and second cylinders and first and second combustion air passages for supplying combustion air to the first and second cylinders, respectively, a first carburetor communicating with the first combustion air passage, having therein a first opening, and including a first fuel supply passageway communicating with the first opening, a second carburetor communicating with the second combustion air passage, having therein a second opening, and including a second fuel supply passageway communicating with the second opening, and a fuel manifold including an integrally molded first manifold portion comprising an elongated portion defining a first main passagewy having a closed end and an opposite open end, and a first nipple portion defining a first nipple passageway communicating betwen the first opening and the first main passageway and extending transversely to the first main passageway, and an integrally molded second manifold portion comprising an elongated portion defining a second main passageway having a closed end and an opposite open end communicating with the open end of the first main passageway, and a second nipple portion defining a second nipple passageway communicating between the second opening and the second main passageway and extending transversely to the second main passageway.

22 Claims, 4 Drawing Sheets

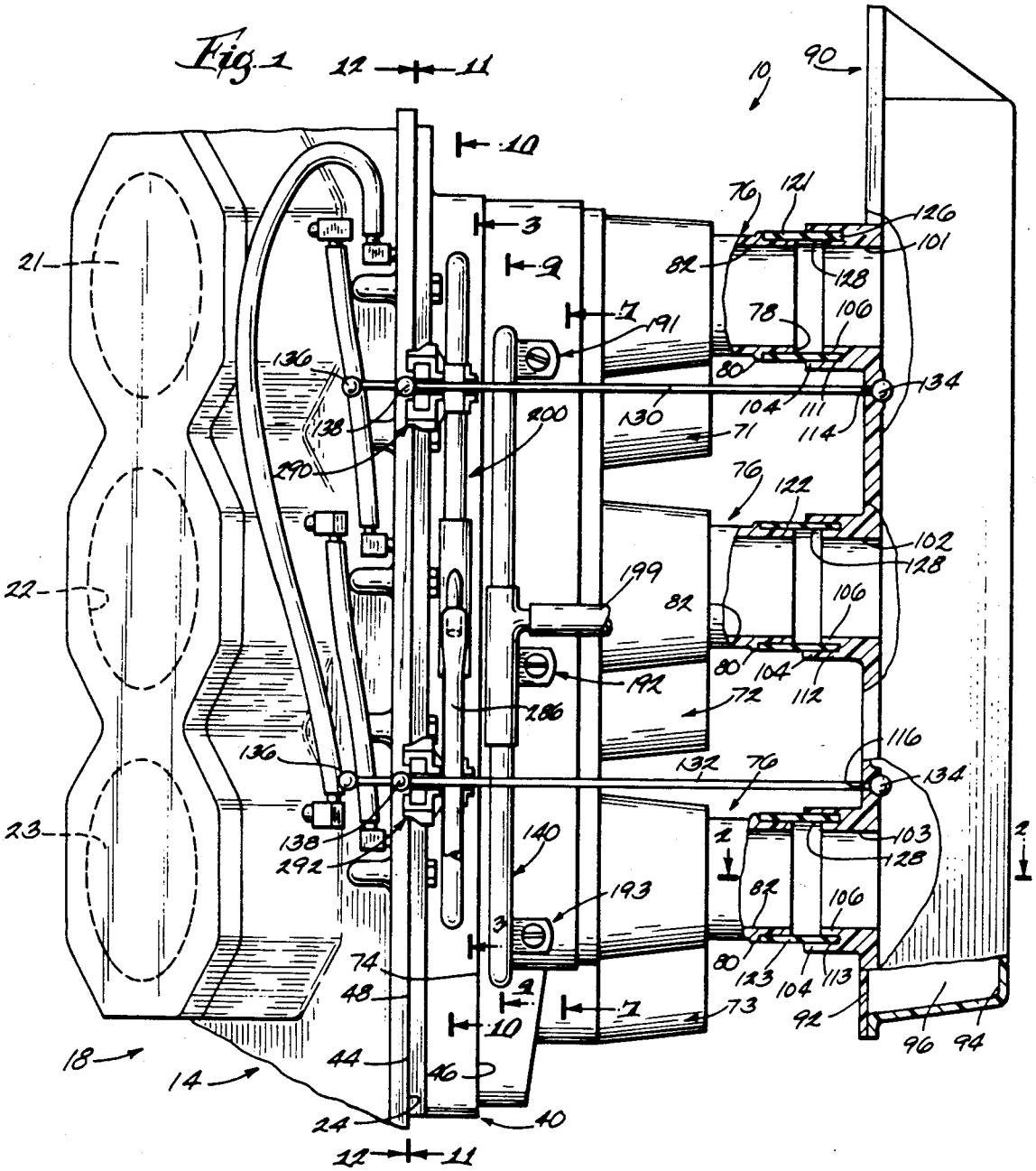
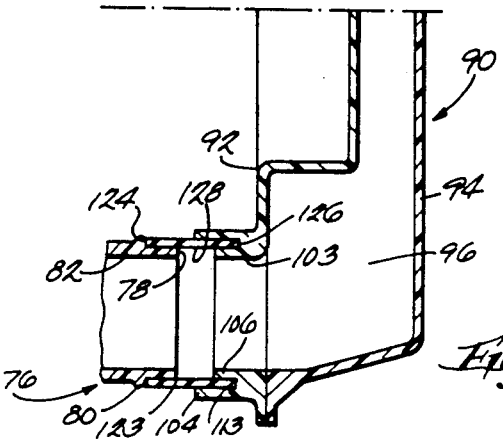
Fig. 2.

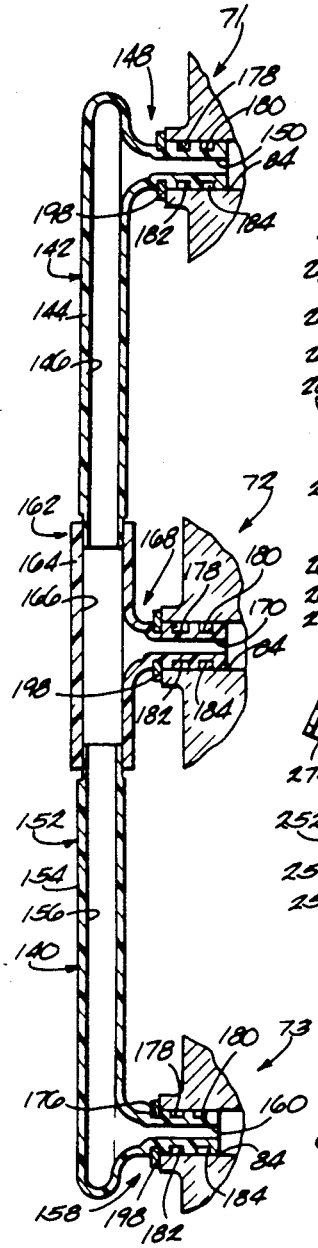
Fig. 9
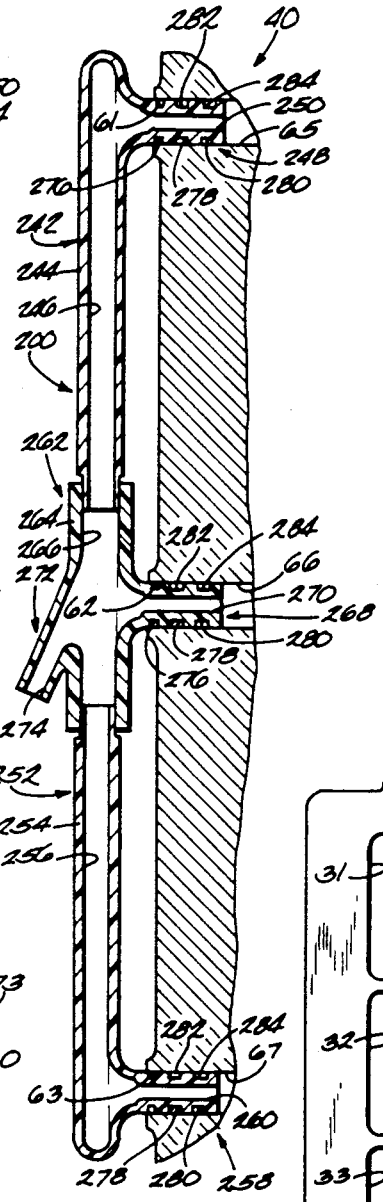
Fig. 10
Fig. 11
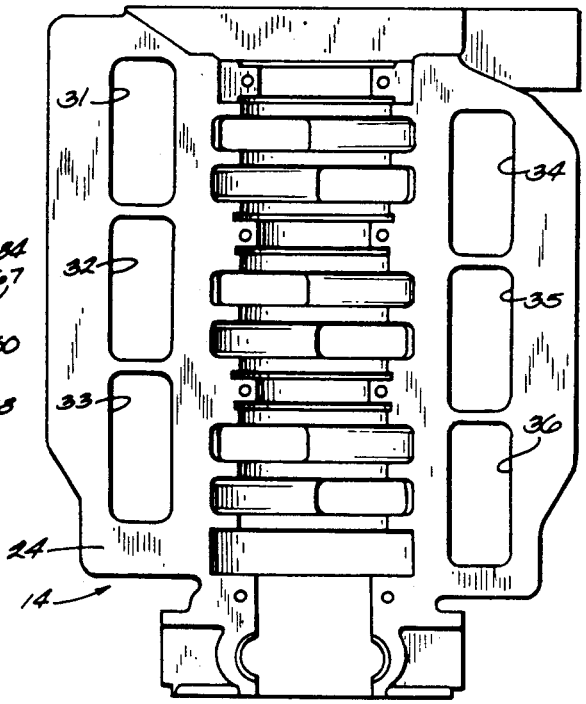

INTERNAL COMBUSTION ENGINE

BACKGROUND OF THE INVENTION

The invention relates to internal combustion engines, and more particularly to marine propulsion device internal combustion engines. Still more particularly, the invention relates to apparatus for supplying fuel and combustion air to marine propulsion device internal combustion engines.

U.S. Pat. No. 4,620,607, which is assigned to the assignee hereof, discloses an air silencer and an arrangement for mounting the air silencer on the intake manifold of an internal combustion engine. The air silencer is connected to the intake manifold by bolts threaded into the intake manifold.

Various arrangements are known for supplying fuel to the carburetors of an internal combustion engine. It is known to use fuel hoses and plastic fittings to form fuel manifolds on engines with multiple carburetors. Also, it is known to connect a plurality of intake manifold intake passages to each other in order to balance the pressure in the intake passages.

Attention is directed to the following U.S. Pat. Nos.:

| | | |
|---|---|---|
| Whitley | 3,032,603 | May 1, 1962 |
| Cochran | 3,090,826 | May 21, 1963 |
| Tezuka, et al. | 4,263,882 | April 28, 1981 |
| Nelson | 4,264,047 | April 28, 1981 |
| Kimura | 4,312,487 | Jan. 26, 1982 |
| Beck | 4,407,472 | Oct. 4, 1983 |
| Schaty | 4,550,891 | Nov. 5, 1985 |
| Breckenfeld, et al. | 4,569,415 | Feb. 11, 1986 |
| Breckenfeld, et al. | 4,620,607 | Nov. 4, 1986 |
| Munch | 4,779,828 | Oct. 25, 1988 |
| Hundertmark | 4,836,506 | June 6, 1989 |

SUMMARY OF THE INVENTION

The invention provides an internal combustion engine comprising an engine block including first and second cylinders and first and second combustion air passages for supplying combustion air to the first and second cylinders, respectively, a first carburetor communicating with the first combustion air passage, having therein a first opening, and including a first fuel supply passageway communicating with the first opening, a second carburetor communicating with the second combustion air passage, having therein a second opening, and including a second fuel supply passageway communicating with the second opening, and a fuel manifold including an integrally molded first manifold portion comprising an elongated portion defining a first main passageway having a closed end and an opposite open end, and a first nipple portion defining a first nipple passageway communicating between the first opening and the first main passageway and extending transversely to the first main passageway, and an integrally molded second manifold portion comprising an elongated portion defining a second main passageway having a closed end and an opposite open end communicating with the open end of the first main passageway, and a second nipple portion defining a second nipple passageway communicating between the second opening and the second main passageway and extending transversely to the second main passageway.

The invention also provides an internal combustion engine comprising an engine block including first and second cylinders and first and second combustion air passages for supplying combustion air to the first and second cylinders, respectively, an intake manifold including first and second intake passages respectively communicating with the first and second combustion air passages, a first opening communicating with the first intake passage, and a second opening communicating with the second intake passage, and a balance manifold including an integrally molded first manifold portion comprising an elongated portion defining a first main passageway having a closed end and an opposite open end, and a first nipple portion defining a first nipple passageway communicating between the first opening and the first main passageway and extending transversely to the first main passageway, and an integrally molded second manifold portion comprising an elongated portion defining a second main passageway having a closed end and an opposite open end communicating with the open end of the first main passageway, and a second nipple portion defining a second nipple passageway communicating between the second opening and the second main passageway and extending transversely to the second main passageway.

The invention also provides a fuel manifold including an integrally molded first manifold portion comprising an elongated portion defining a first main passageway having a closed end and an opposite open end, and a first nipple portion defining a first nipple passageway which is adapted to communicate with the carburetor of an internal combustion engine, which communicates with the first main passageway, and which extends transversely to the first main passageway, and an integrally molded second manifold portion comprising an elongated portion defining a second main passageway having a closed end and an opposite open end communicating with the open end of the first main passageway, and a second nipple portion defining a second nipple passageway which is adapted to communicate with the carburetor of an internal combustion engine, which communicates with the second main passageway, and which extends transversely to the second main passageway.

The invention also provides a balance manifold including an integrally molded first manifold portion comprising an elongated portion defining a first main passageway having a closed end and an opposite open end, and a first nipple portion defining a first nipple passageway which is adapted to communicate with an intake manifold intake passage, which communicates with the first main passageway, and which extends transversely to the first main passageway, and an integrally molded second manifold portion comprising an elongated portion defining a second main passageway having a closed end and an opposite open end communicating with the open end of the first main passageway, and a second nipple portion defining a second nipple passageway which is adapted to communicate with an intake manifold intake passage, which communicates with the second main passageway, and which extends transversely to the second main passageway.

A principal feature of the invention is the provision of the above-described fuel manifold and the above-described balance manifold. The disclosed manifold construction provides a one-piece manifold with a minimum number of connections. For example, the only connections in the fuel manifold are to the carburetors and to the fuel supply hose. This reduces the possibility of fuel leakage and avoids other disadvantages of known arrangements for supplying fuel to carburetors.

Other features and advantages of the invention will become apparent to those skilled in the art upon review of the following detailed description, claims and drawings.

DESCRIPTION OF THE DRAWINGS

FIG. 1 is a side elevational view of a marine propulsion device embodying the invention.

FIG. 2 is a view taken along line 2—2 in FIG. 1.

FIG. 9 is a view taken along line 9—9 in FIG. 1.

FIG. 10 is a view taken along line 10—10 in FIG. 1.

FIG. 11 is a view taken along line 11—11 in FIG. 1.

Figure 7:
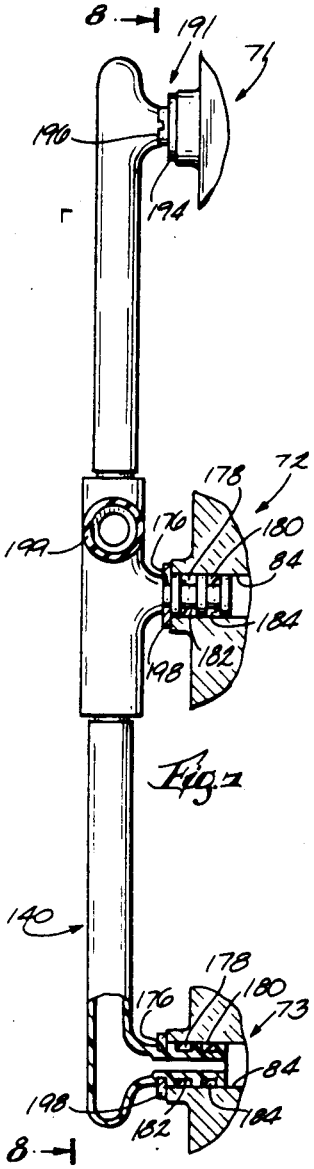
FIG. 7 is a view taken along line 7—7 in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An internal combustion engine 10 embodying the invention is illustrated in the drawings. While the engine 10 can have various suitable constructions and can be either a two-stroke or a four-stroke engine, the illustrated engine is a V-6, two-stroke engine.

The engine 10 includes (see FIG. 1) an engine block 14 defining two banks 18 of cylinders. Preferably, the engine block is substantially identical to the block disclosed in U.S. Ser. No. 315,900, which was filed Feb. 27, 1989, and which is incorporated herein by reference. Only one bank 18 of cylinders is illustrated in the drawings and described herein. The other cylinder bank 18 is essentially a mirror image of the one described. The cylinder bank 18 includes first, second and third cylinders 21, 22 and 23, respectively. The engine block 14 also includes (see FIG. 11) a manifold mounting surface 24, first, second and third combustion air passages 31, 32 and 33 extending from the manifold mounting surface 24 for supplying combustion air to the cylinders 21, 22 and 23, respectively, and combustion air passages 34, 35 and 36 extending from the manifold mounting surface 24 for supplying combustion air to the cylinders of the other bank.

Figure 3:
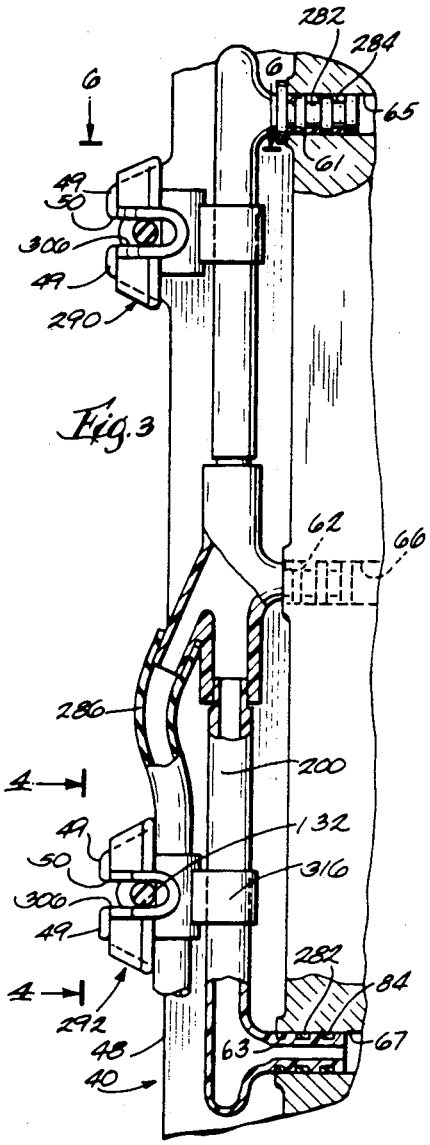
FIG. 3 is a view taken along line 3—3 in FIG. 1.
Figure 12:
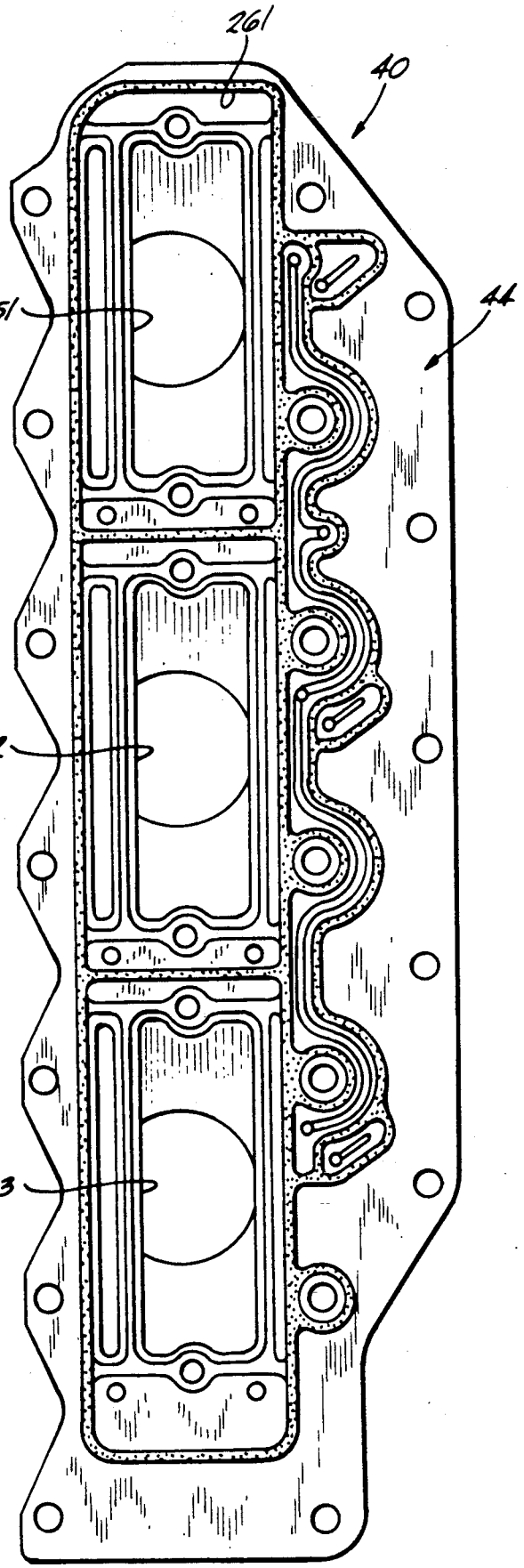
FIG. 12 is a view taken along line 12—12 in FIG. 1.

The engine 10 also includes (see FIG. 1) a pair of substantially identical intake manifolds 40 fixed to the engine block 14 by suitable means. Only the intake manifold 40 associated with the illustrated cylinder bank 18 is shown and described herein. The intake manifold 40 includes (see FIGS. 1 and 12) an engine mounting surface 44 abutting the manifold mounting surface 24 of the engine block 14, and an opposite carburetor mounting surface 46 (FIG. 1). The intake manifold 40 also includes (see FIGS. 1 and 3) a side surface 48 extending between the engine mounting surface 44 and the carburetor mounting surface 46. The side surface 48 includes (see FIG. 3) two pairs of spaced apart lateral projections 49 defining recesses 50, the reason for which is explained hereinafter. The intake manifold 40 has therethrough (see FIG. 12) first, second and third intake passages 51, 52 and 53 extending between the carburetor mounting surface 46 and the engine mounting surface 44 and respectively communicating with the first, second and third combustion air passages 31, 32 and 33 of the engine block 14. The intake manifold 40 further has therein (see FIGS. 3 and 10) first, second and third balance openings 61, 62 and 63 respectively communicating with the first, second and third intake passages 51, 52 and 53 via first, second and third balance passageways 65, 66 and 67. Preferably, the intake manifold 40 is substantially identical to the intake manifold disclosed in U.S. Ser. No. 482,932, which was filed Feb. 20, 1990, and which is incorporated herein by reference.

The engine 10 also includes (see FIG. 1) first, second and third carburetors 71, 72 and 73 associated with the illustrated intake manifold 40. (The engine 10 also includes carburetors which are associated with the other intake manifold, which are substantially identical to the carburetors 71, 72 and 73, and which are not shown or described herein.) Each carburetor 71, 72 or 73 includes (see FIG. 1) a manifold mounting surface 74 abutting the carburetor mounting surface 46 of the intake manifold 40. The carburetors 71, 72 and 73 can be mounted on the intake manifold 40 by any suitable means. Each carburetor 71, 72 or 73 also includes (see FIGS. 1 and 2) an intake portion 76 including an outer surface 78 opposite the manifold mounting surface 74. The intake portion 76 has thereon a shoulder 80, the reason for which is explained hereinafter. Each carburetor 71, 72 or 73 also includes an intake passage 82 extending between the outer surface 78 and the manifold mounting surface 74. The intake passage 82 of the first carburetor 71 communicates with the first intake manifold intake passage 51, the intake passage 82 of the second carburetor 72 communicates with the second intake manifold intake passage 52, and the intake passage 82 of the third carburetor 73 communicates with the third intake manifold intake passage 53. Each carburetor 71, 72 or 73 further includes (see FIGS. 7 and 9) a fuel supply opening 84, and means (not shown) communicating with the fuel supply opening 84 for supplying fuel to the carburetor intake passage 82. Such means is known in the art and will not be described in greater detail.

The engine 10 also includes (see FIGS. 1 and 2) an air silencer 90. The air silencer 90 includes spaced apart inner and outer walls 92 and 94 defining therebetween a silencing chamber 96. The inner wall 92 has therein (see FIG. 1) first, second and third outlet openings 101, 102 and 103 communicating with the silencing chamber 96 and with the first, second and third carburetors 71, 72 and 73, respectively, as described below. (The inner wall 92 also has therein openings (not shown) communicating with the carburetors associated with other cylinder bank.) The inner wall 92 also has thereon three pairs of radially spaced projections 104 and 106 defining first, second and third annular recesses 111, 112 and 113 respectively surrounding the first, second and third outlet openings 101, 102 and 103. The inner wall 92 of the air silencer 90 also has therethrough upper and lower openings 114 and 116, the reason for which is explained hereinafter.

The engine 10 also includes (see FIG. 1) first, second and third tubular resilient members 121, 122 and 123 respectively communicating with the first, second and third carburetors 71, 72 and 73 and with the first, second and third air silencer outlet openings 101, 102 and 103. Each resilient member 121, 122 or 123 has (see FIG. 2) a first or inner end 124 abutting the shoulder 80 on the associated carburetor 71, 72 or 73 so that a portion of the member 121, 122 or 123 surrounds the inlet portion 76 of the associated carburetor, and each member 121, 122 or 123 also has an opposite second end 126 housed in the associated recess 111, 112 or 113 in the air silencer 90. Each member 121, 122 or 123 forms a seal between the air silencer 90 and the associated carburetor 71, 72 or 73 and maintains a space between the air silencer 90 and the associated carburetor 71, 72 or 73, so that the member 121, 122 or 123 defines a passageway 128 communicating between the air silencer 90 and the intake passage 82 of the associated carburetor 71, 72 or 73.

The engine 10 further includes (see FIG. 1) means for securing the air silencer 90 to the intake manifold 40 (and thus to the engine block 14) and for facilitating removal of the air silencer 90 from the intake manifold 40 (and thus from the engine block 14). While various suitable means can be employed, in the illustrated construction, such means includes, on the illustrated side of the engine 10, upper and lower elastic connectors 130 and 132, respectively, extending between the air silencer 90 and the intake manifold 40. (The securing means also includes upper and lower connectors (not shown) on the other side of the engine 10.) While various suitable constructions can be used, in the illustrated embodiment, each connector 130 or 132 has an enlarged forward end 134, an enlarged rearward end 136, and an enlarged portion 138 adjacent but spaced from the rearward end 136. Each connector 130 or 132 extends through an associated one of the openings 114 and 116 in the air silencer wall 92 so that the enlarged forward end 134 abuts the inner wall 92 and prevents the forward end 134 of the connector 130 or 132 from being pulled rearwardly through the opening 114 or 116.

The means for securing the air silencer 90 to the intake manifold 40 also includes means for releasably securing the connectors 130 and 132 to the intake manifold 40 (and thus to the engine block 14). While various suitable means can be employed, in the illustrated construction, this means includes (see FIGS. 3–6) the recesses 50 in the intake manifold 40. More particularly, as shown in the drawings, each connector 130 or 132 extends through an associated one of the recesses 50 so that the enlarged portion 138 engages the engine mounting surface 44 of the intake manifold 40 and prevents the enlarged portion 138 from being pulled forwardly through the recess 50. Each connector 130 or 132 must be stretched from its relaxed state in order to locate the enlarged portion 138 in the associated recess 50. The enlarged rearward end 136 of each connector 130 or 132 facilitates gripping of the connector so that the connector can be stretched to locate the enlarged portion 138 in the associated recess 50 or to remove the enlarged portion 138 from the associated recess 50.

Figure 8:
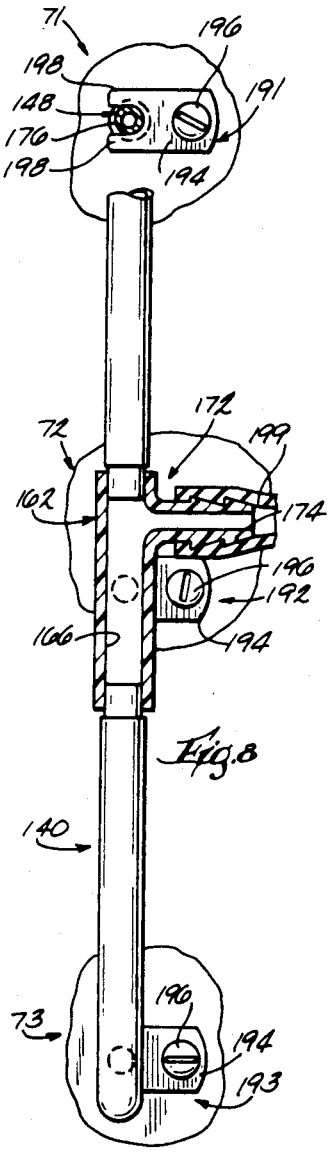
FIG. 8 is a view taken along line 8—8 in FIG. 7.

The engine 10 further includes (see FIGS. 1 and 7–9) a fuel manifold 140 for supplying fuel to the carburetors 71, 72 and 73. The fuel manifold 140 is preferably fabricated of plastic and includes (see FIG. 9) an integrally molded (i.e., injection molded as a single piece) first or upper manifold portion 142 comprising an elongated portion 144 defining a first or upper main passageway 146 having a closed upper end and an open lower end, and a first or upper nipple portion 148 defining a first or upper nipple passageway 150 communicating between the opening 84 in the first carburetor 71 and the upper main passageway 146 and extending transversely to the upper main passageway 146. The fuel manifold 140 also includes an integrally molded second or lower manifold portion 152 comprising an elongated portion 154 defining a second or lower main passageway 156 having a closed lower end and an open upper end, and a second or lower nipple portion 158 defining a second or lower nipple passageway 160 communicating between the opening 84 in the third carburetor 73 and the lower main passageway 156 and extending transversely to the lower main passageway 156. The fuel manifold 140 also includes an integrally molded third or center manifold portion 162 comprising an elongated portion 164 defining a third or center main passageway 166 having an open first or lower end communicating with the upper end of the lower main passageway 156, and having an open second or upper end communicating with the lower end of the upper main passageway 146. The center manifold portion 162 also comprises a third or center nipple portion 168 defining a third or center nipple passageway 170 communicating between the opening 84 in the second carburetor 72 and the center main passageway 166 and extending transversely to the center main passageway 166. The center manifold portion 162 also comprises (see FIG. 8) a fuel supply nipple 172 defining a nipple fuel passageway 174 communicating with the center main passageway 166. Preferably, the nipple fuel passageway 174 extends transversely to the center main passageway 166. Also, each of the nipple portions 148, 158 and 168 has therein (see FIGS. 7 and 9) first, second and third annular grooves or recesses 176, 178 and 180, respectively.

The manifold portions 142, 152 and 162 are connected by suitable means such as bonding. Because the upper and lower main passageways 146 and 156 communicate with the center main passageway 166, the upper and lower main passageways 146 and 156 also communicate with each other. In the illustrated construction, the main passageways 146, 156 and 166 are coaxial and the nipple passageways 150, 160 and 170 are generally parallel and extend substantially perpendicular to the main passageways 146, 156 and 166. The nipple passageway 174 is generally perpendicular to both the passageways 146, 156 and 166 and the passageways 150, 160 and 170.

The engine 10 further includes (see FIGS. 7 and 9) sealing means surrounding each of the nipple portions 148, 158 and 168 and sealingly engaging the associated carburetor 71, 72 or 73 and the assoicated nipple portion 148, 158 or 168. While various suitable means can be employed, in the illustrated construction, such means includes, for each of the nipple portions 148, 158 and 168, an 0-ring 182 seated in the second groove 178 and an O-ring 184 seated in the third groove 180.

The engine 10 further includes (see FIGS. 7–9) means for securing the fuel manifold 140 to the carburetors 71, 72 and 73. While various suitable securing means can be employed, in the illustrated embodiment, such means includes (see FIG. 8) first clip means 191 which is fixed to the first carburetor 71 and which engages the upper nipple portion 148, second clip means 192 which is fixed to the second carburetor 72 and which engages the center nipple portion 168, and third clip means 193 which is fixed to the third carburetor 73 and which engages the lower nipple portion 158. Preferably, each of the clip means 191, 192 and 193 includes (see FIG. 8)

a clip 194 fixed to the associated carburetor 71, 72 or 73 by a bolt or screw 196 threaded into the carburetor 71, 72 or 73. Each clip 194 includes (see FIGS. 8 and 9) spaced apart projections 198 extending into the first recess 176 in the associated nipple portion 148, 158 or 168 so as to prevent axial movement of the nipple portion relative to the associated carburetor 71, 72 or 73.

The engine 10 further includes (see FIGS. 1, 7 and 8) means for supplying fuel to the fuel manifold 140. While various suitable means can be used, in the illustrated construction, such means includes a fuel supply conduit 199 communicating between a suitable source of fuel (not shown) and the fuel supply nipple 172.

The engine 10 further includes (see FIGS. 1, 3 and 10) a balance manifold 200 communicating between the first, second and third intake manifold intake passages 51, 52 and 53. The balance manifold 200 is preferably fabricated of plastic and includes (see FIG. 10) an integrally molded first or upper manifold portion 242 comprising an elongated portion 244 defining a first or upper main passageway 246 having a closed upper end and an open lower end, and a first or upper nipple portion 248 defining a first or upper nipple passageway 250 communicating between the first opening 61 in the intake manifold 40 and the upper main passageway 246 and extending transversely to the upper main passageway 246. The balance manifold 200 also includes an integrally molded second or lower manifold portion 252 comprising an elongated portion 254 defining a second or lower main passageway 256 having a closed lower end and an open upper end, and a second or lower nipple portion 258 defining a second or lower nipple passageway 260 communicating between the third opening 63 in the intake manifold 40 and the lower main passageway 256 and extending transversely to the lower main passageway 256. The balance manifold 200 also includes an integrally molded third or center manifold portion 262 comprising an elongated portion 264 defining a third or center main passageway 266 having an open first or lower end communicating with the upper end of the lower main passageway 256, and having an open second or upper end communicating with the lower end of the upper main passageway 246. The center manifold portion 262 also comprises a third or center nipple portion 268 defining a third or center nipple passageway 270 communicating between the second opening 62 in the intake manifold 40 and the center main passageway 266 and extending transversely to the center main passageway 266. The center manifold portion 262 also comprises a suction nipple 272 defining a suction passageway 274 communicating with the center main passageway 266. Preferably, the suction passageway 274 extends transversely to the center main passageway 266. Also, each of the nipple portions 248, 258 and 268 has therein first, second and third annular grooves or recesses 276, 278 and 280.

The manifold portions 242, 252 and 262 are connected by suitable means such as bonding. In the illustrated construction, the main passageways 246, 256 and 266 are coaxial and the nipple passageways 250, 260 and 270 are generally parallel and extend substantially perpendicular to the main passageways 246, 256 and 266. The nipple passageway 274 extends in the same plane as the passageways 246, 256, 266, 250, 260 and 270. Preferably, the upper and lower manifold portions 242 and 252 are respectively identical to the upper and lower manifold portions 142 and 152.

The engine 10 further includes (see FIGS. 3 and 10) sealing means surrounding each of the nipple portions 248, 258 and 268 and sealingly engaging the intake manifold 40 and the associated nipple portion 248, 258 or 268. While various suitable means can be employed, in the illustrated construction, such means includes, for each of the nipple portions 248, 258 and 268, an O-ring 282 seated in the second groove 278 and an O-ring 284 seated in the third groove 280.

The engine 10 further includes (see FIGS. 1 and 3) a suction conduit 286 having one end communicating with the suction nipple 272. The opposite end of the suction conduit 286 communicates with a suitable location such as the air silencer or the main bearing drain.

The engine 10 further includes (see FIGS. 1 and 3–6) means for securing the balance manifold 200 to the intake manifold 40 and for securing the suction conduit 286 to the intake manifold 40. While various suitable means can be employed, in the illustrated embodiment such means includes clip means for releasably securing the balance manifold 200 and the suction conduit 286 to the intake manifold 40. In the illustrated construction, the clip means includes (see FIGS. 1 and 3) upper and lower clips 290 and 292, respectively. The clips 290 and 292 are substantially identical, and only the lower clip 292 will be described herein.

Figure 5:
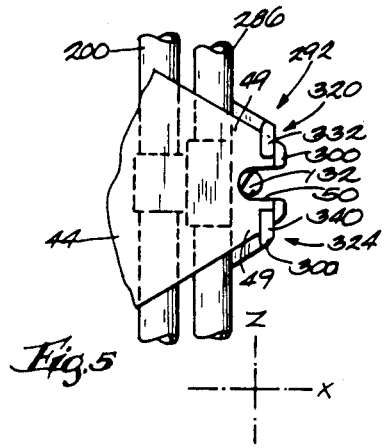
FIG. 5 is a view taken along line 5—5 in FIG. 4.
Figure 4:
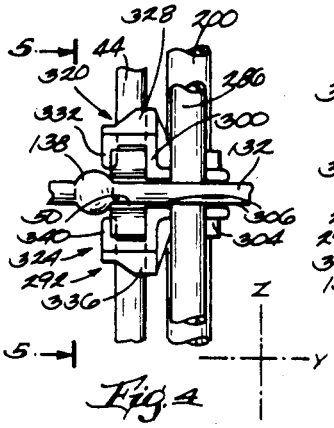
FIG. 4 is a view taken along line 4—4 in FIG. 3.
Figure 6:
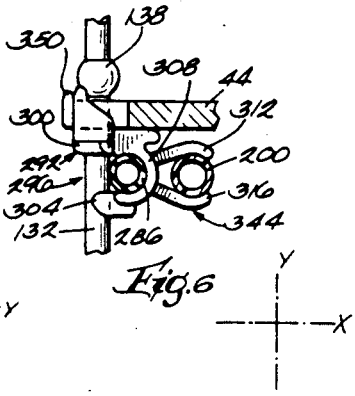
FIG. 6 is a view taken along line 6—6 in FIG. 3.

The clip 292 will be described by reference to mutually perpendicular X, Y and Z axes which are shown in FIGS. 4–6. The clip 292 includes (see FIG. 6) a generally C-shaped portion 296 including spaced-apart legs 300 and 304 extending generally parallel to the X axis. The legs 300 and 304 have therein (see FIGS. 3 and 4) aligned guide recesses 306. The C-shaped portion 296 also includes (see FIG. 6) a base portion 308 connecting the legs 300 and 304. The clip 292 also includes a pair of spaced-apart arms 312 and 316 extending from the base portion 308, extending generally parallel to the X axis, and extending in the opposite direction from the legs 300 and 304. The clip 292 also includes (see FIGS. 4 and 5) a pair of spaced-apart L-shaped extensions 320 and 324 extending from the leg 300. The first extension 320 includes (see FIG. 4) a first portion 328 extending from the leg 300, extending generally parallel to the Y axis, and extending in the direction away from the leg 304. The extension 320 also includes a second portion 332 spaced from the leg 300, extending from the first portion 328, extending generally parallel to the Z axis, and extending toward the L-shaped extension 324. The second L-shaped extension 324 includes (see FIG. 4) a first portion 336 extending from the leg 300, extending generally parallel to the Y axis, and extending in the direction away from the leg 304. The second extension 324 also includes a second portion 340 spaced from the leg 300, extending from the first portion 336, extending generally parallel to the Z axis, and extending toward the L-shaped extension 320. The second portions 332 and 340 of the L-shaped extensions 320 and 324 are preferably generally colinear. The arms 312 and 316 define a first clip portion 344 (FIG. 6) which releasably retains the balance manifold 200. The C-shaped portion 296 defines a second clip portion. The second clip portion or C-shaped portion 296 of the clip 292 releasably retains the suction conduit 286. As shown in FIG. 4, the connector 132 extends through the guide recesses 306 of the lower clip 292 and also extends over the suction conduit 286 so as to retain the suction conduit 286 in the second clip portion or C-shaped portion 296.

The clips 290 and 292 are preferably releasably connected to the intake manifold 40. In the illustrated construction, each of the extensions 320 and 324 fits over an associated projection 49, each of the intake manifold projections 49 has thereon (see FIGS. 4 and 6) a rearwardly extending projection 350, and the portions 332 and 340 of each clip 290 and 292 snap over the associated projections 350.

Various features of the invention are set forth in the following claims.

We claim:

1. An internal combustion engine comprising an engine block including first and second cylinders and first and second combustion air passages for respectively supplying combustion air to said first and second cylinders, a first carburetor communicating with said first combustion air passage, having therein a first opening, and including a first fuel supply passageway communicating with said first opening, a second carburetor communicating with said second combustion air passage, having therein a second opening, and including a second fuel supply passageway communicating with said second opening, and a fuel manifold including an integral, one piece first manifold portion comprising an elongated portion defining a first main passageway having a closed end and an opposite open end, and a first nipple portion defining a first nipple passageway communicating between said first opening and said first main passageway and extending transversely to said first main passageway, and an integral, one piece second manifold portion comprising an elongated portion defining a second main passageway having a closed end and an opposite open end communicating with said open end of said first main passageway, and a second nipple portion defining a second nipple passageway communicating between said second opening and said second main passageway and extending transversely to said second main passageway.

2. An internal combustion engine as set forth in claim 1 wherein said engine block includes a third cylinder and a third combustion air passage for supplying combustion air to said third cylinder, wherein said engine also comprises a third carburetor communicating with said third combustion air passage, having therein a third opening, and including a third fuel supply passageway communicating with said third opening, and wherein said fuel manifold also includes an integrally molded third manifold portion comprising an elongated portion defining a third main passageway having an open first end communicating with said open end of said first main passageway, and having an open opposite second end communicating with said open end of said second main passageway, and a third nipple portion defining a third nipple passageway communicating between said third opening and said third main passageway and extending transversely to said third main passageway.

3. An engine as set forth in claim 2 wherein said third manifold portion also comprises a fuel supply nipple defining a nipple fuel passageway communicating with said third main passageway, and wherein said engine further comprises a fuel supply conduit communicating with said nipple fuel passageway.

4. An engine as set forth in claim 3 wherein said nipple fuel passageway extends transversely to said third main passageway.

5. An internal combustion engine as set forth in claim 1 wherein said fuel manifold also includes a fuel supply nipple defining a nipple fuel passageway communicating with at least one of said main passageways, and wherein said engine further comprises a fuel supply conduit communicating with said nipple fuel passageway.

6. An engine as set forth in claim 1 wherein said manifold portions are fabricated of plastic.

7. An engine as set forth in claim 1 and further comprising sealing means surrounding said first nipple portion and sealingly engaging said first carburetor and said first nipple portion, and sealing means surrounding said second nipple portion and sealingly engaging said second carburetor and said second nipple portion.

8. An engine as set forth in claim 1 and further comprising means for securing said first nipple portion to said first carburetor and for securing said second nipple portion to said second carburetor.

9. An engine as set forth in claim 8 wherein said securing means includes first clip means which is fixed to said first carburetor and which engages said first nipple portion, and second clip means which is fixed to said second carburetor and which engages said second nipple portion.

10. An engine as set forth in claim 9 wherein said first nipple portion has therein a first recess, wherein said first clip means engages said first recess, wherein said second nipple portion has therein a second recess, and wherein said second clip means engages said second recess.

11. An internal combustion engine comprising an engine block including first and second cylinders and first and second combustion air passages for respectively supplying combustion air to said first and second cylinders, an intake manifold including first and second intake passages respectively communicating with said first and second combustion air passages, a first opening communicating with said first intake passage, and a second opening communicating with said second intake passage, and a balance manifold including an integral, one piece first manifold portion comprising an elongated portion defining a first main passageway having a closed end and an opposite open end, and a first nipple portion defining a first nipple passageway communicating between said first opening and said first main passageway and extending transversely to said first main passageway, and an integral, one piece second manifold portion comprising an elongated portion defining a second main passageway having a closed end and an opposite open end communicating with said open end of said first main passageway, and a second nipple portion defining a second nipple passageway communicating between said second opening and said second main passageway and extending transversely to said second main passageway.

12. An internal combustion engine as set forth in claim 11 wherein said engine block includes a third cylinder and a third combustion air passage for supplying combustion air to said third cylinder, wherein said intake manifold also includes a third intake passage communicating with said third combustion air passage, and a third opening communicating with said third intake passage, and wherein said balance manifold also includes an integrally molded third manifold portion comprising an elongated portion defining a third main passageway having an open first end communicating with said open end of said first main passageway, and having an open opposite second end communicating with said open end of said second main passageway, and a third nipple portion defining a third nipple passageway communicating between said third opening and said third main passageway and extending transversely to said main third passageway.

13. An engine as set forth in claim 12 wherein said third manifold portion also comprises a suction nipple defining a suction passageway communicating with said third main passageway, and wherein said engine further comprises a suction conduit communicating with said suction passageway.

14. An engine as set forth in claim 11 wherein said balance manifold also includes a suction nipple defining a suction passageway communicating with at least one of said main passageways, and wherein said engine further comprises a suction conduit communicating with said suction passageway.

15. An engine as set forth in claim 11 wherein said manifold portions are fabricated of plastic.

16. An engine as set forth in claim 11 and further comprising sealing means surrounding said first nipple portion and sealingly engaging said intake manifold and said first nipple portion, and sealing means surrounding said second nipple portion and sealingly engaging said intake manifold and said second nipple portion.

17. An engine as set forth in claim 11 and further comprising means for securing said balance manifold to said intake manifold.

18. An engine as set forth in claim 17 wherein said securing means includes clip means.

19. An engine as set forth in claim 18 wherein said clip means is releasably secured to said intake manifold.

20. An engine as set forth in claim 19 wherein said balance manifold also includes a suction nipple defining a suction passageway communicating with at least one of said main passageways, wherein said engine further comprises a suction conduit communicating with said suction passageway, and wherein said clip means secures said suction conduit to said intake manifold.

21. A fuel manifold including an integral, one piece first manifold portion comprising an elongated portion defining a first main passageway having a closed end and an opposite open end, and a first nipple portion defining a first nipple passageway which is adapted to communicate with a carburetor forming a part of an internal combustion engine, which communicates with said first main passageway, and which extends transversely to said first main passageway, and an integrally molded second manifold portion comprising an elongated portion defining a second main passageway having a closed end and an opposite open end communicating with said open end of said first main passageway, and a second nipple portion defining a second nipple passageway which is adapted to communicate with a carburetor forming a part of the internal combustion engine, which communicates with said second main passageway, and which extends transversely to said second main passageway.

22. A balance manifold including an integral, one piece first manifold portion comprising an elongated portion defining a first main passageway having a closed end and an opposite open end, and a first nipple portion defining a first nipple passageway which is adapted to communicate with an intake manifold intake passage, which communicates with said first main passageway, and which extends transversely to said first main passageway, and an integrally molded second manifold portion comprising an elongated portion defining a second main passageway having a closed end and an opposite open end communicating with said open end of said first main passageway, and a second nipple portion defining a second nipple passageway which is adapted to communicate with an intake manifold intake passage, which communicates with said second main passageway, and which extends transversely to said second main passageway.

* * * * *